United States Patent [19]

Takebe et al.

[11] Patent Number: 4,847,658

[45] Date of Patent: Jul. 11, 1989

[54] IMAGE FORMING APPARATUS AND IMAGE FORMING METHOD EMPLOYED THEREFOR

[75] Inventors: Kaoru Takebe; Naoki Toyoshi; Hiroshi Okamoto; Kenji Tabuchi; Mineyuki Sako, all of Osaka, Japan

[73] Assignee: Minolta Camera Kabushiki Kaisha, Osaka, Japan

[21] Appl. No.: 203,157

[22] Filed: Jun. 7, 1988

[30] Foreign Application Priority Data

Jun. 9, 1987 [JP] Japan ..... 62-144517

[51] Int. Cl.[4] ..... G03G 15/01

[52] U.S. Cl. ..... 355/245; 355/77; 355/311; 430/31

[58] Field of Search ..... 355/14 D, 14 R, 3 DD, 355/4, 77; 430/31, 42, 100, 122

[56] References Cited

U.S. PATENT DOCUMENTS 4,239,374 12/1980 Tatsumi et al. ..... 355/14 D
4,579,443 4/1986 Abuyama et al. ..... 355/4
4,582,417 4/1986 Yagasaki et al. ..... 355/7
4,659,211 4/1987 Oka ..... 355/14 D
4,733,276 3/1988 Katitani ..... 355/14 D
4,752,802 6/1988 Ito et al. ..... 355/3 DD

FOREIGN PATENT DOCUMENTS 950767 7/1974 Canada .
61-256357 11/1986 Japan .

*Primary Examiner*—R. L. Moses
*Attorney, Agent, or Firm*—Burns, Doane, Swecker & Mathis

[57] ABSTRACT

An image forming apparatus for use in an electrophotographic copying process and an image forming method for the apparatus, which are arranged to reproduce an image portion of an original document by a black developing material on a white paper sheet when an area of the image portion of the original document is below a predetermined level, and also, reproducing a background portion of the image by a white developing material on a black paper sheet when the area of the image portion of the original document is above the predetermined level, and thus, the black developing material or white developing material is selectively used according to percentages of image areas on the original document.

5 Claims, 5 Drawing Sheets

IMAGE FORMING APPARATUS AND IMAGE FORMING METHOD EMPLOYED THEREFOR

BACKGROUND OF THE INVENTION

The present invention generally relates to electrophotography and more particularly, to an image forming apparatus for use in an electrophotographic copying process, and an image forming method employed therefor.

Conventionally, in a copying apparatus employing a two or dual-component developing material composed of toner and carrier, it has been so arranged to maintain a toner mixing ratio constant in a developing material through successive replenishment of an amount of toner to be consumed by developing.

However, owing to the recent expansion in the application of the copying apparatus, there has been an increasing number of cases where photographic original documents, in which image portions occupy a considerably large area, are to be copied as well as original documents in characters, and when the images of such photographic documents are continuously copied in a large number, there are cases where newly replenished toner is not sufficiently mixed with the carrier so as to be fed for the developing as it is uncharged, thus inviting such problems as generation of fogging on the copied images, soiling of surrounding appliances by the toner scattering in dust, and reduction of the follow-up characteristic in the image density.

SUMMARY OF THE INVENTION

Accordingly, as essential object of the present invention is to provide an image forming apparatus for use in an electrophotographic copying process and an image forming method employed therefor, which are arranged to selectively use a black developing material or white developing material according to percentages of image areas in original documents, with substantial elimination of disadvantages inherent in the conventional arrangements of this kind.

Another object of the present invention is to provide an image forming apparatus and an image forming method as described above, which may be readily employed in an electrophotographic copying process through a simple construction.

In accomplishing these and other objects, according to one aspect of the present invention, there is provided an image forming apparatus for use in an electrophotographic copying process, which comprises a photosensitive member, means for charging the photosensitive member, means for forming an electrostatic latent image corresponding to an original document on said photosensitive member, a first developing means for developing the electrostatic latent image through employment of first toner charged in a polarity opposite to that of the charging polarity, a second developing means for developing the electrostatic latent image through employment of second toner in a different color from that of the first toner and charged to the same polarity as that of the charging polarity, a first paper feeding means for feeding first paper having the same color as that of the second toner to a transfer region confronting the photosensitive member, a second paper feeding means for feeding second paper having the same color as that of the first toner to the transfer region confronting said photosensitive member, means for detecting ratio between an image portion on the original document and a background portion except for the image portion, and a control means for selecting said first developing means and said first paper feeding means so as to form the image of the first toner on the first paper when the ratio of the image portion is below a predetermined amount based on the output from said detecting means, and for selecting said second developing means and said second paper feeding means so as to form the image of the second toner on the second paper when the ratio of the image portion is above the predetermined amount.

In another aspect of the present invention, there is also provided an image forming method which includes the steps of reproducing an image portion of an original document by a black developing material on a white paper sheet when an area of the image portion of the original document is below a predetermined level, and also, reproducing a background portion of the image by a white developing material on a black paper sheet when the area of the image portion of the original document is above the predetermined level.

By the arrangements according to the present invention as described above, an improved image forming apparatus and method have been advantageously presented for use in an electrophotographic copying process.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
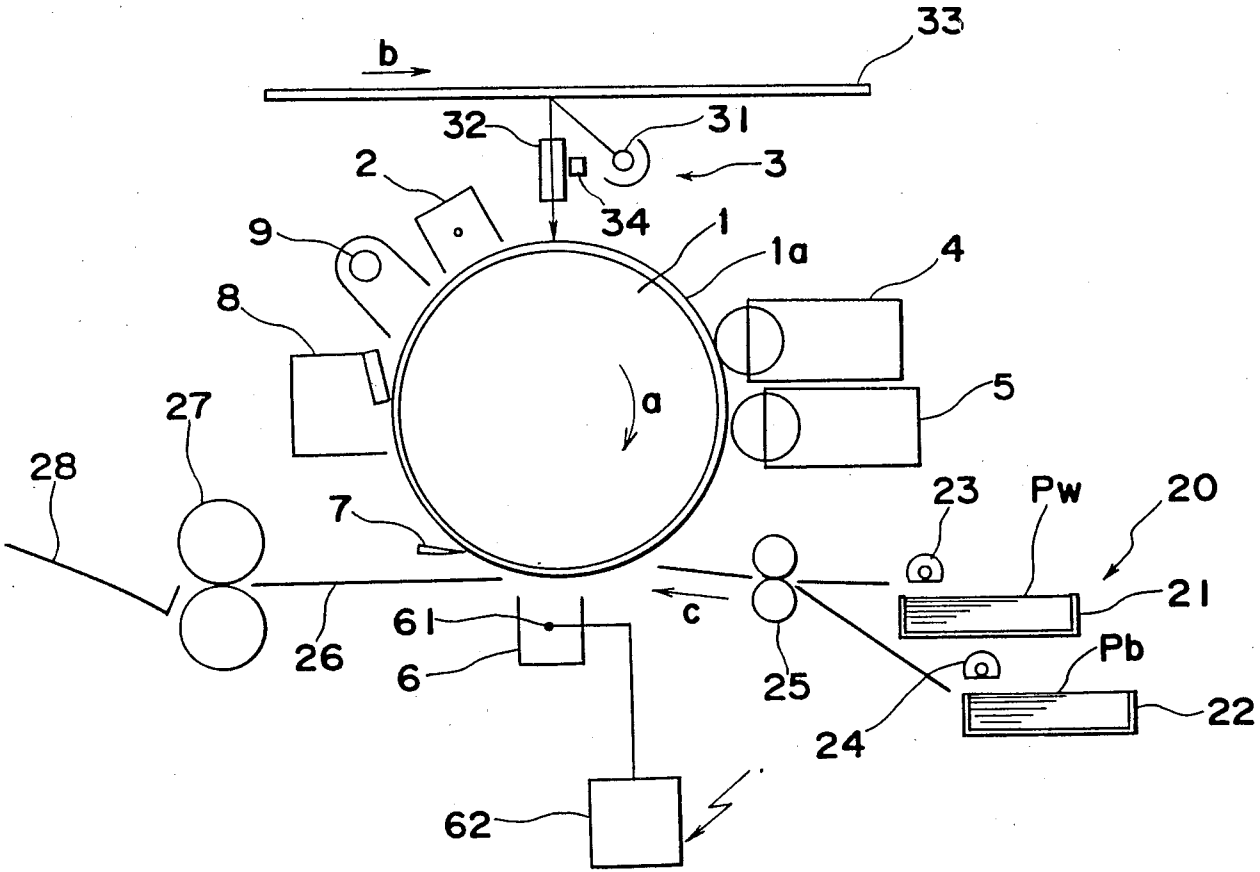
FIG. 1 is a schematic side sectional view of an electrophotographic copying apparatus to which the present invention may be applied.

Before the description of the present invention proceeds, it is to be noted that like parts are designated by like reference numerals throughout the accompanying drawings.

Referring now to the drawings, there is shown in FIG. 1 an electrophotographic copying apparatus to which an image forming method according to the present invention may be applied. The copying apparatus generally includes a known photosensitive or photoreceptor drum 1 having a photoconductive or photosensitive layer 1*a* on its outer periphery and rotatably disposed generally at a central portion of the apparatus for rotation in a direction indicated by an arrow a, and various processing stations such as a corona charger 2, an optical system or image exposing device 3, an inter-image eraser (not shown), a first developing unit 4, a second developing unit 5, a transfer charger 6, a separating claw 7, a cleaning device 8, and an eraser lamp 9, etc. which are sequentially disposed around the photoreceptor drum 1 as shown, with a paper feeding section 20 and a paper discharge section 26 being disposed at the right and left sides of the photoreceptor drum 1.

The corona charger 2 is intended to impart a charge of a predetermined potential (charge of a negative polarity in this embodiment) onto the photosensitive surface 1*a* of the photoreceptor drum 1.

The image exposing device 3 is to form an electrostatic latent image corresponding to an image of an original document onto the photoconductive surface 1*a* of the photoreceptor drum 1 through the known slit exposure system by projecting light rays onto the original document (not particularly shown) placed on a transparent original document platform 33, e.g. of glass capable of scanning in a direction indicated by an arrow b. This image exposing device 3 includes an exposure lamp 31, and a lens array 32 composed of single image transmitters 32 in a bundled configuration arranged side by side, etc.

Moreover, the image exposing device 3 is further provided with a photo-electric converting element 34 so as to receive part of the reflected light of the light rays projected onto the original document by the exposure lamp 31, and to convert the light amount into an electrical signal for application to a control unit (FIG. 6), where the white to black ratio (to be described in more detail later) of the original document is calculated based on said electrical signal.

The first developing unit 4 and the second developing unit 5, both of the magnetic brush system, are intended to develop the electrostatic latent image formed on the photoconductive surface l*a* of the photoreceptor drum 1 into a visible toner image, and a developing material containing white toner is accommodated in the first developing unit 4, while another developing material containing black toner is accommodated in the second developing unit 5.

For the change-over between the first and second developing units 4 and 5, there may be employed, for example, such arrangements that (1) the respective developing units are displaceably supported with respect to the photoreceptor drum 1 so that the desired developing unit is brought close to the surface l*a* of the photoreceptor drum 1 depending on necessity, (2) the magnet roller provided within a developing sleeve is adapted to be rotatable by a predetermined angle for change-over between the developing state in which the magnetic pole confronts the surface 1*a* of the photoreceptor drum 1 and the non-developing state in which the portion between the magnetic poles faces the surface 1*a* of the photoreceptor drum 1, and (3) the bias voltage to be applied to the developing sleeve is rendered to be higher during the non-developing period than in the developing period, etc. Since such arrangements are fully described, for example, in U.S. patent application Ser. No. 59,850 assigned to the same assignee as in the present invention, detailed description thereof is abbreviated here for brevity.

The developing materials are each composed of a mixture of magnetic carrier and insulative toner which are charged to polarities opposite to each other through triboelectric charging, and in the present embodiment, the white toner in the developing material of the first developing unit 4 is charged to the negative polarity, while the black toner in the developing material of the second developing unit 5 is charged to the positive polarity. It is to be noted here that the above developing materials are transported in the known manner, and develop the electrostatic latent image formed on the photoconductive surface l*a* of the photoreceptor drum 1.

The transfer charger 6 is intended to transfer the toner image formed on the photoconductive surface l*a* of the photoreceptor drum 1 by the first or second developing unit 4 or 5, onto a copy paper sheet, and has its corona wire 61 connected to a power source transformer 62 so that the polarity of the voltage applied to the corona wire 61 can be changed over based on signals from the control unit.

The separating claw 7 has for its object to separate the copy paper sheet immediately after the transfer from the photoconductive surface 1*a* of the photoreceptor drum 1.

The cleaning unit 8 of a blade type is to remove the toner remaining on the surface 1*a* of the drum 1.

The eraser lamp 9 is intended to eliminate the residual charge remaining on the surface 1*a* of the photoreceptor drum 1 by light projection in order to prepare for the subsequent copy processing.

The paper feeding section 20 is provided with a first paper feeding cassette 21 and a second paper feeding cassette 22, and in the first paper feeding cassette 21, normal white copy paper sheets Pw are accommodated, while in the second paper feeding cassette 22, black copy paper sheets Pb are contained, and these copy paper sheets Pw and Pb are arranged to be fed based on rotation of paper feeding rollers 23 and 24 respectively.

Figure 6:
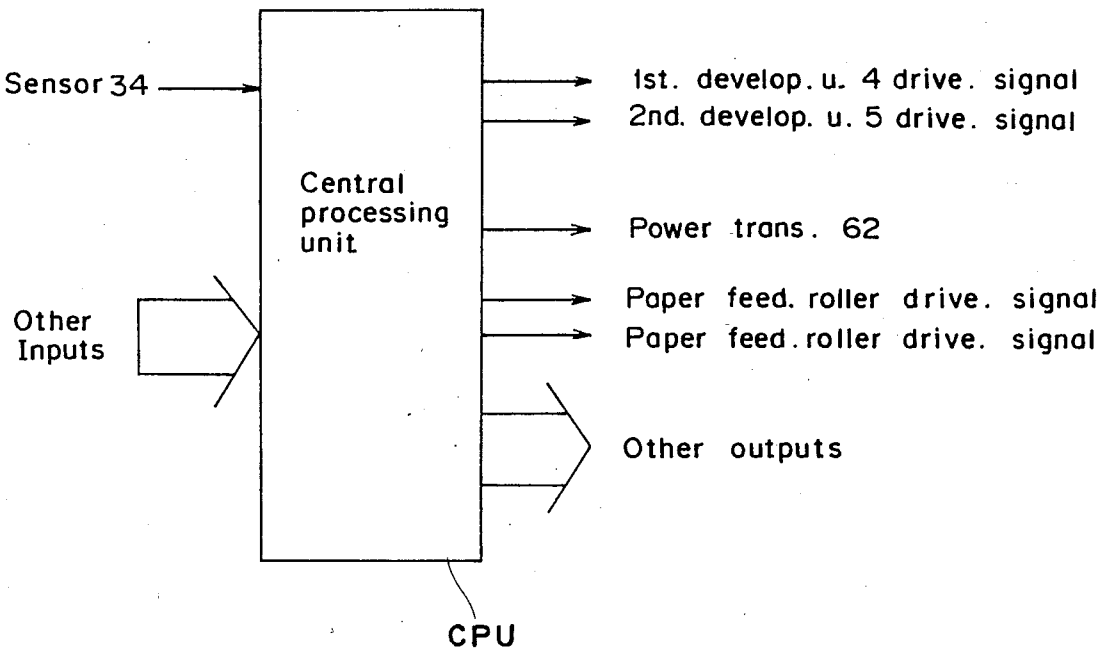
FIG. 6 is a block diagram showing the relation of inputs applied to a central processing unit as a control device, and outputs to be produced therefrom.

As shown in FIG. 6, for the control of various functions to be described hereinafter, the output of the photoelectric converting element or sensor 34 is applied, together with other inputs, to a central processing unit CPU for the control device, which is adapted to produce driving signals for the first and second developing units 4 and 5, power transformer 62, paper feeding roller driving signals, and other outputs for the operation of the apparatus.

Figure 2:
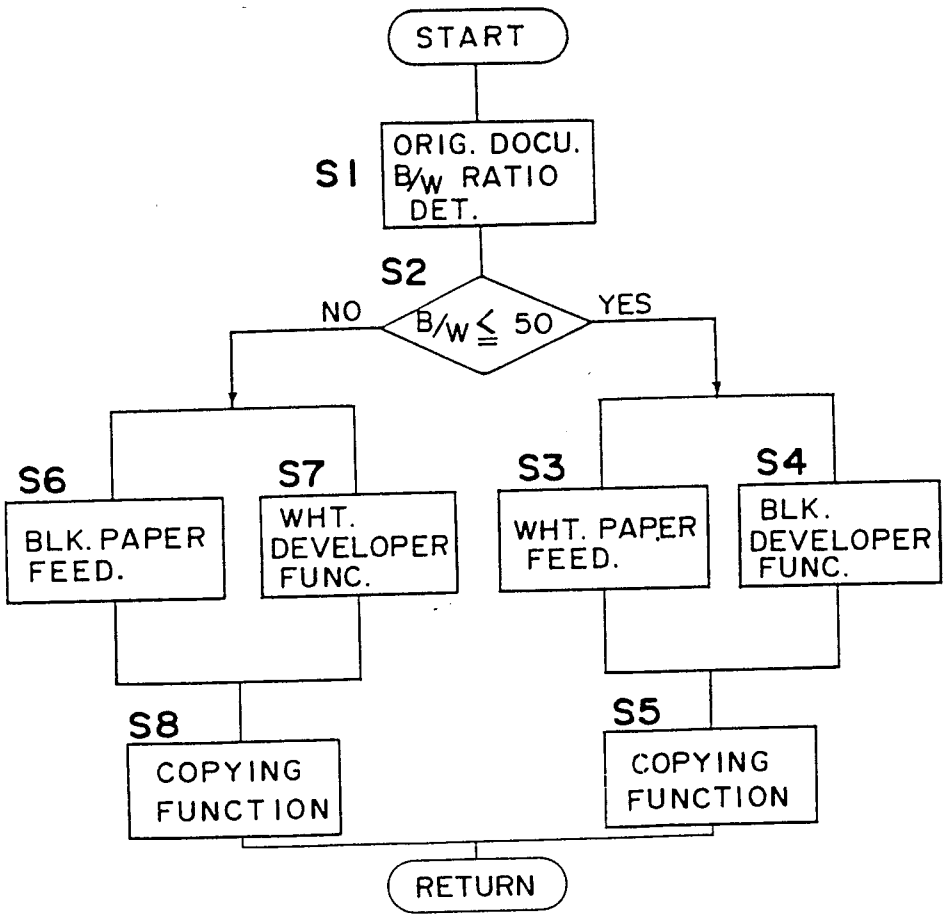
FIG. 2 is a flow-chart for explaining a general function of the copying apparatus of FIG. 1.

Functioning of the copy apparatus having the constructions as described so far will be explained hereinafter with reference to a flow-chart of FIG. 2.

<Step S1>

Firstly, at step S1, upon turning on of a print switch, with an original document (not shown) being placed on the original document platform 33, said platform 33 preliminarily scans in the direction of the arrow b, and light is projected onto the original document from the exposure lamp 31 of the image exposing device 3, while part of the reflected light is detected by the photo-electric converting element 34 so as to convert its light amount into the electrical signal to be applied to the control unit.

At the control unit, the white/black ratio $\alpha$ of the original document is detected by the known method based on said electrical signal.

$$\alpha = (\text{image portion area}/\text{original document area}) \times 100\%$$

[original documentarea = image portion area + background portion area]

<Step S2>

At step S2, it is checked by the control unit whether or not the white/black ratio $\alpha$ is lower than 50%.

Figure 3:
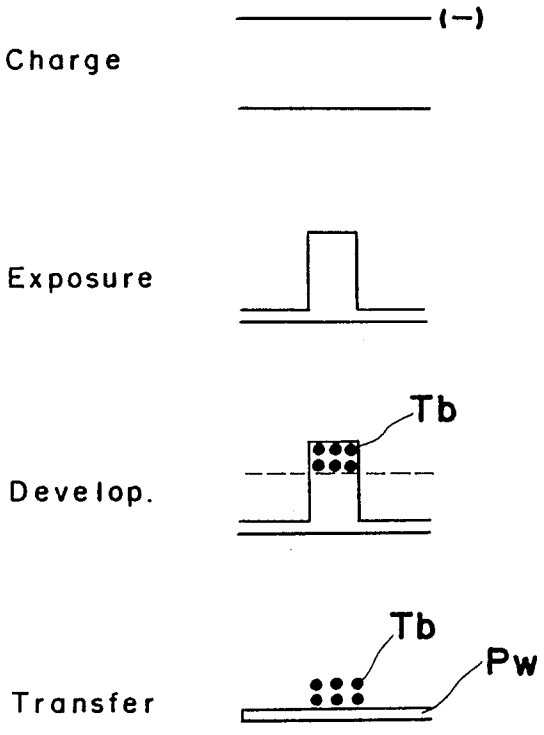
FIG. 3 is a chart for explaining a regular developing/copying process.
Figure 5:
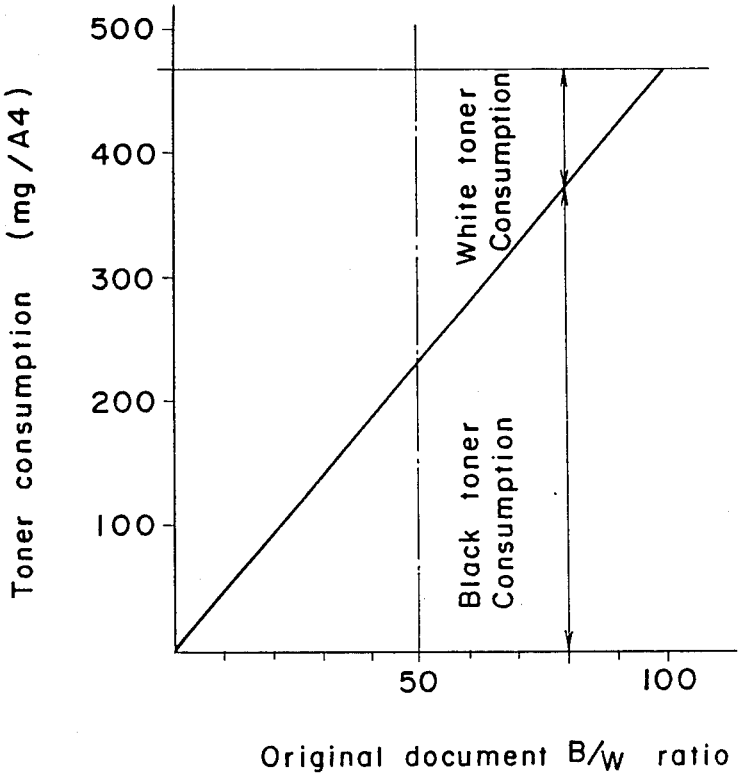
FIG. 5 is a graphical diagram showing the relation between original document white to black ratio and toner consumption.

In the case where the white/black ratio $\alpha$ is lower than 50%, i.e., when the ratio occupied by the black image in the original document falls short of 50%, the procedure proceeds to steps S3 and S4 so as to execute the regular developing process shown in FIG. 3.

Figure 4:
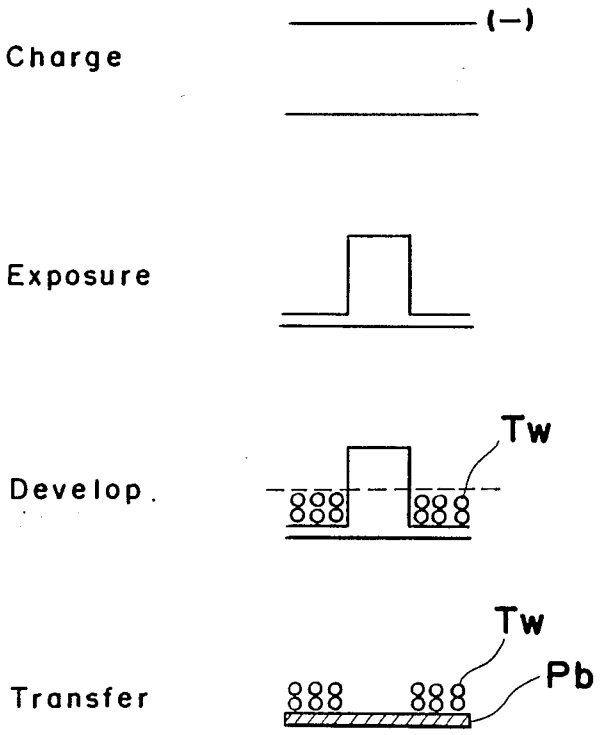
FIG. 4 is a chart for explaining a reversal developing/copying process.

On the contrary, in the case where the white/black ratio $\alpha$ is equal to or higher than 50%, i.e., when the ratio occupied by the black image in the original document exceeds 50%, the procedure proceeds to steps S6 and S7 so as to execute the reversal developing process as shown in FIG. 4.

<Steps S3 to S5> (FIG. 3)

In the case where the white/black ratio of the original document is lower than 50%, the black developing unit (the second developing unit) 5 is set in the developing state, with the first developing unit 4 being conversely set in the non-developing state, while the voltage of negative polarity is applied to the corona wire 61 of the transfer charger 6 so as to execute the copying operation in the order as illustrated in FIG. 3.

More specifically, under the state where the photoreceptor drum 1 is rotated in the direction indicated by the arrow a, the photoconductive surface 1*a* of the photoreceptor drum 1 is uniformly charged to the negative polarity by the discharge of the corona charger 2. Subsequently, the original document platform 33 of the image exposing device 3 scans in the direction of the arrow b, and the reflected light of the light rays irradiated from the exposure lamp 31 is projected onto the photoconductive surface 1*a* of the photoreceptor drum 1 through the lens array 32, thereby forming an electrostatic latent image corresponding to the original document image on said surface 1*a*. In this case, the charge at the portion corresponding to the image portion (electrostatic latent image portion) is retained as it is, while the charge at the portion corresponding to the background portion (electrostatic latent image background portion) is removed.

As the photoreceptor drum 1 is rotated, the electrostatic latent image formed on the surface 1*a* of said drum 1 is transported in the direction of the arrow a, and upon arrival at a portion confronting the second developing unit 5 after passing through the first developing unit 4, the black toner charged to the positive polarity is supplied to the electrostatic latent image portion, thereby visualizing the image as a black toner image Tb. It is to be noted here that, since the first developing unit 4 is in the non-developing state in this case, the white toner is not fed to the electrostatic latent image portion.

On the other hand, at the paper feeding section 20, the white copy paper sheets Pw accommodated in a stack on the cassette 21 are fed by the paper feeding roller 23, one sheet by one sheet, from the uppermost sheet of the stack, and are transported by a pair of timing rollers 25 in a timed relation with the toner image, to the confronting portion (i.e., transfer region) between the transfer charger 6 and the photoreceptor drum 1, at which portion the black toner image Tb is electrostatically transferred onto the white copy paper sheet Pw based on the discharge (in a negative polarity) of the transfer charger 6.

The white copy paper sheet Pw transferred with the black toner image Tb in the above described manner is transported, along the transport guide 26, to a fixing device 27, and after being fixed with the toner image Tb by fusing thereat, is discharged onto the paper discharge portion 28.

<Steps S6 to S8> (FIG. 4)

When the white/black ratio of the original document exceeds 50%, the first developing unit 4 is set in the developing state contrary to the above case, with the second developing unit 5 being set under the non-developing state, while the voltage of positive polarity is applied to the corona wire 61 of the transfer charger 6 so as to execute the copying operation in the order as shown in FIG. 4.

After the photoconductive surface l*a* has been charged to the negative polarity by the corona discharge from the corona charger 2, light is projected onto said photoconductive surface l*a* through the image exposing device 3, whereby an electrostatic latent image corresponding to the original image is formed on said surface l*a*.

Subsequently, at the portion confronting the first developing unit 4, the white toner charged to the negative polarity is electrostatically fed to the electrostatic latent image background portion, and thus, the background image by the white toner is formed on the photosensitive drum 1. It is to be noted here that, in this case, since the second developing unit 5 is set in the non-developing state, no black toner is supplied onto the photoconductive surface 1*a* of the photoreceptor drum 1.

On the other hand, at the paper feeding section 20, the black copy paper sheets Pb accommodated in a stack on the cassette 22 are fed by the paper feeding roller 24, one sheet by one sheet, from the uppermost sheet of the stack, and are transported by the pair of timing rollers 25 in a timed relation with the toner image, to the confronting portion (i.e., transfer region) between the transfer charger 6 and the photoreceptor drum 1, at which portion the white toner image Tw is electrostatically transferred onto the black copy paper sheet Pb based on the discharged (in a positive polarity) of the transfer charger 6, thereby forming a reversal image. In other words, the background image is formed by the white toner on the black copy paper sheet Pb, and consequently, the image is formed as if the image portion was reproduced by the black toner on the white copy paper sheet.

In the case where an original document of A4 size is to be copied onto the copy paper sheet of the same size, when the original document with the white/black ratio at 80% is reproduced on the white copy paper sheet through employment of the black toner, about 370 g of toner is consumed per one copying operation, while on the contrary, if said original document is reproduced through adoption of the reversal developing process, the consumption of the white toner is limited only to approximately 90 g.

It is to be noted here that, in the foregoing embodiment, although the developing units and the colors of the paper sheets to be fed are adapted to be changed with respect to the white/black ratio $\alpha=50\%$ as a boundary line, such boundary line at $\alpha=50\%$ need not necessarily be employed, but the change-over of the developing units and colors of the paper sheets may be suitably determined based on various conditions such as prices of toner, paper sheets, etc.

As is clear from the foregoing description, according to the image forming method of the present invention, it is so arranged that the developing units to be used and copy paper sheets to be fed are changed over.

Accordingly, even when an original document having a very high percentage to be occupied by the image portion, e.g., at the white/black ratios in the range of 80 to 90%, is copied, the consumption of the white developing material is substantially the same as that required in the regular development of an image with the image area of 10 to 20%.

Therefore, even when an original document having a large image area is continuously copied, only a small amount of toner replenishment is required, and it is possible to quickly raise the potential of the replenishing toner to a level suitable for the developing through sufficient mixing of the toner and carrier, with the result that the follow-up characteristic of the image density is improved so as to provide images at high quality without fogging, etc., while clean circumstances may be maintained, since toner dust is not generated.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus for use in an electrophotographic copying process, which comprises:

a photosensitive member;

means for charging the photosensitive member;

means for forming an electrostatic latent image corresponding to an original document on said photosensitive member;

a first developing means for developing the electrostatic latent image through employment of first toner charged in a polarity opposite to that of the charging polarity;

a second developing means for developing the electrostatic latent image through employment of second toner in a different color from that of the first toner and charged to the same polarity as that of the charging polarity;

a first paper feeding means for feeding first paper having the same color as that of the second toner to a transfer region confronting the photosensitive member;

a second paper feeding means for feeding second paper having the same color as that of the first toner to the transfer region confronting said photosensitive member;

means for detecting ratio between an image portion on the original document and a background portion; and a control means for selecting said first developing means and said first paper feeding means so as to form the image with said first toner on said first paper when said ratio is below a predetermined level based on the output from said detecting means, and for selecting said second developing means and said second paper feeding means so as to form the image with said second toner on said second paper when said ratio is above said predetermined level.

2. An image forming apparatus as claimed in claim 1, wherein said second toner image is white.

3. An image forming apparatus as claimed in claim 1, wherein said first toner image is black.

4. An image forming apparatus as claimed in claim 1, further including a transfer charger provided at a transfer region confronting said photosensitive member, said transfer charger being arranged to be applied with a voltage having the same polarity as that of the charging polarity for transferring said first toner onto, said first paper, and also with a voltage opposite in polarity to that of the charging polarity for transferring the second toner to said second paper.

5. An image forming method which comprises the steps of reproducing an image portion of an original document by a black developing material on a white paper sheet when a ratio of the area of the image portion of the original document to an area of background portion is below a predetermined level, and also, reproducing a background portion of the image by a white developing material on a black paper sheet when said ratio is above said predetermined level.

* * * * *